US006231430B1

(12) United States Patent
Dill

(10) Patent No.: US 6,231,430 B1
(45) Date of Patent: May 15, 2001

(54) CARBON ELECTRODE CLEANING SYSTEM AND METHOD

(75) Inventor: Raymond J. Dill, Florence, AL (US)

(73) Assignee: Dill Engineering, Inc., Florence, AL (US)

( * ) Notice: Subject to any disclaimer, the term of this patent is extended or adjusted under 35 U.S.C. 154(b) by 0 days.

(21) Appl. No.: 09/408,254

(22) Filed: Sep. 29, 1999

(51) Int. Cl.[7] ..... B08B 1/02

(52) U.S. Cl. ..... 451/54; 451/57; 451/69; 15/90; 15/93.1; 134/6; 29/81.11

(58) Field of Search ..... 451/28, 51, 54, 451/57, 59, 67, 69, 177; 15/89, 90, 91, 93.1; 134/6; 29/81.01, 81.11, 81.16

(56) References Cited

U.S. PATENT DOCUMENTS 1,597,332 8/1926 Waddell et al. .
3,224,022 12/1965 Kehr .
3,343,986 9/1967 Howery et al. .
4,418,435 12/1983 Arnold .
4,472,852 9/1984 Dill .
4,514,873 5/1985 Golla .
4,557,009 12/1985 Dill .
4,723,334 2/1988 Rieg .
5,294,318 3/1994 Grant, Jr. et al. .
5,676,761 10/1997 Gormanos et al. .

*Primary Examiner*—Eileen P. Morgan
(74) *Attorney, Agent, or Firm*—Lanier Ford Shaver & Payne P.C.; David L. Berdan

(57) ABSTRACT

The present invention is directed to improved apparatus' for dislodging and abrading cryolite encrustations from carbon anodes spent during aluminum smelting. Both the plow blade and flailing elements of the present invention are constructed and arranged to substantially conform to the shape of the spent carbon butts to facilitate rapid and efficient cleaning of the spent carbon anodes' surfaces. Systems and methods employing the substantially V-shaped plow blade extension and dual directional rotating flailing assemblies are also disclosed.

3 Claims, 13 Drawing Sheets

CARBON ELECTRODE CLEANING SYSTEM AND METHOD

BACKGROUND OF INVENTION

1. Field of Invention

The present invention relates generally to the field of carbon electrode cleaning, and more particularly to the cleaning of spent frame mounted carbon butts following an aluminum smelting process.

2. Technical Background

Aluminum smelting is a chemical reduction process which converts alumina (aluminum oxide) into aluminum and oxygen. The reduction process is typically preformed in a large reduction cell that includes a carbon lined container or "pot" at least partially filled with a molten mixture of alumina dissolved in cryolite and other materials such as fluorides. The carbon lined steel pot forms the cathode while a plurality of frame mounted carbon blocks suspended in the bath form the associated anodes.

During smelting, a voltage potential is applied between the carbon anodes and the pot, resulting in a large current flow from the anodes through the molten bath mixture to the cathode. The electrical current passing through the bath reduces the alumina into its aluminum and oxygen components, which results in the aluminum ions falling from the mixture to the bottom of the pot and oxygen ions reacting with the carbon provided by the carbon blocks to form CO and $CO_2$. Thus, while aluminum is being formed, the carbon blocks are slowly being consumed over time due to the ongoing chemical reaction of the oxygen with the carbon. Generally, these waste gasses are vented from the pot and the non-suspended aluminum is periodically evacuated from the cell. Over time, this reaction necessitates the replacement of the spent anodes in order to maintain adequate production levels of aluminum.

A by-product of the above-described reaction is the formation of a hardened crust atop the cell. The crust is predominantly formed of cryolite, which over time, begins to accumulate on the carbon blocks and their associated support stubs. Thus, when the anodes are removed from the bath, the remaining carbon remnants or butts supported on the frame of the anodes are substantially covered by a hardened encrustation of cryolite, which until removed, prevents reuse of the remaining carbon butts. Because recycled carbon seasoned by aluminum smelting is preferable to non-seasoned carbon for new or replacement carbon anodes used in aluminum smelting, aluminum manufacturers favor removal of the cryolite encrustation from the spent carbon anodes over disposal of the encrusted anodes as carbon butts can be recycled and reused to make new carbon blocks for later use in the smelting process.

Heretofore, several methods have been employed to remove the cryolite encrustation from the carbon anodes. One such method involves a combination of manually hammering and scrapping the anode to substantially remove the hardened encrustation. Another method employs powered scraping arms, which act upon the cryolite. Still another method employs a vibrating scraping tool. Each of these methods, however, are labor intensive, time consuming, and are generally viewed by the industry as too slow to keep pace with aluminum smelting plants. As many smelting plants typically manufacture their own electrodes as a companion function to smelting, the electrode manufacturing process must keep in step with the smelting process. Accordingly, anode cleaning processes must adhere to strict time guidelines in order to provide the requisite number of cleaned carbon butts desired for new or replacement carbon anode manufacture.

In addition, due to technological advances in reduction cell operation, aluminum smelting plants can now add heavier blankets of alumina to the production cell, which in turn fosters the formation of a thicker and denser crust atop the reduction cell and thus provides for greater heat retention. While this is preferable for increased aluminum output, these advances have resulted in the formation of harder and denser cryolite encrustation formed on the spent anodes.

Accordingly, there is a need for an approved carbon electrode cleaning system and method capable of disengaging these harder cryolite encrustations from the anode frames and carbon butts. More specifically, there is a need for a cleaning system that substantially conforms to the shape of typical carbon butts that remain affixed to the stubs of the anodes so that the encrustation can be removed without additional labor intensive and time consuming manual cleaning operations. Such a device should be simple to use, consistent in operation, and capable of keeping pace with modem smelting and carbon anode reclamation processes preformed at aluminum processing plants. It is to the provision of such a system and method that the present invention is primarily directed.

SUMMARY OF INVENTION

One aspect of the present invention relates to a method of cleaning a spent carbon anode, the spent carbon anode including a carbon butt, a frame having a yolk and stub for supporting the carbon butt, and an encrustation affixed to the spent carbon anode. The method includes the steps of urging a plow blade into and through the encrustation such that the plow blade passes between the frame and carbon butt to disengage a significant portion of the encrustation from the spent carbon anode. The method further includes the step of rotationally engaging the frame and carbon butt with first flailing elements rotating in a first plane with respect to the spent carbon anode to abrade additional encrustation from the spent carbon anode. The frame and carbon butt are also rotationally engaged by second flailing elements rotating in a second plane with respect to the spent carbon anode to further abrade additional encrustation from the spent carbon anode. Rotation of the flailing elements in the second plane is substantially orthogonal to rotation of the flailing elements in the first plane.

In another aspect, the present invention is directed to a system for cleaning a spent carbon anode. The spent carbon anode includes a carbon butt, a frame including a yolk and stub for supporting the carbon butt, and an encrustation affixed to the spent carbon anode. The system includes a conveyer for transporting the spent carbon anode, and a first station communicating with the conveyer to receive and engage the spent carbon anode. The first station includes a plow assembly having a laterally extendable plow blade constructed and arranged to dislodge a significant portion of the encrustation from the spent carbon anode as the plow blade is extended through the spent carbon anode between the carbon butt and the frame. A second station communicating with the conveyer downstream of the first station receives the spent carbon anode conveyed from the first station. The second station includes a first rotatable flailing assembly having first flailing elements constructed and arranged to rotatably engage the spent carbon anode in a first plane to abrade additional encrustation from the spent carbon anode. A third station communicates with the conveyer downstream of the second station to receive the spent carbon anode conveyed from the second station. The third station includes a second rotatable flailing assembly having second flailing elements constructed and arranged to rotatably engage the spent carbon anode in a second plane to abrade additional encrustation from the spent carbon anode. Again, rotation in the second plane is substantially orthogonal to rotation in the first plane.

An additional aspect of the present invention relates to an apparatus for removing an encrustation from a spent carbon anode having a carbon butt defining at least one concave groove on its upper surface, and a frame having a yolk and stub for supporting the carbon butt. The apparatus comprises a drive motor, a shaft rotatably coupled to the drive motor, and an elongated flailing element affixed to the shaft at a location remote from the drive motor. The elongated flailing element is constructed and arranged to substantially conform to the shape of the concave groove defined in the upper surface of the carbon butt upon rotation of the shaft.

Yet another aspect of the present invention is directed to an apparatus for removing an encrustation from a spent carbon anode including a carbon butt defining at least one concave groove on its upper surface and a frame having a yolk and stub for supporting the carbon butt. The apparatus includes a drive motor, a plow beam extendably coupled to the drive motor, and a plow blade affixed to an end of the plow beam remote from the drive motor. The plow blade includes a blade extension that is sized and shaped to substantially conform to the shape of the concave groove, and is adapted to dislodge a substantial portion of the encrustation from the concave groove upon extension of the plow beam.

The improved carbon electrode cleaning system and method of the present invention results in a number of advantages over other devices and methods known in the art. For example, the improved plow blade of the present invention is sized and shaped to engage the encrustation at the crust line adjacent the upper surface of the carbon butt within the concave groove defined thereon. Rapid disengagement of the encrustation from the carbon butt is thus facilitated enabling the plow blade to pass through the entire length of the spent carbon anode in a single stroke. Other devices lacking this feature, have been known to stall at some point during the initial stroke.

Additionally, the use of the dual directional flailing assemblies in accordance with the present invention provides substantially more scrubbing of the spent carbon anode surface area in a much shorter period of time than other systems and methods presently known in the art. As a result, the yolk, stubs, and carbon butt of the spent carbon anodes carry far less residual encrustation following cleaning in accordance with the present invention.

Moreover, the unique curvilinear orbital path of the flailing elements of one embodiment of the flailing assemblies of the present invention enable the flailing assembly to be laterally inserted between the yolk, stubs and upper surface of the carbon butt. The construction and arrangement of these flailing elements further facilitate cleaning of the concave groove defined within the upper surface of the carbon butt, as the flailing elements substantially conform to the shape of the concave groove. Accordingly, manually manipulated tools are no longer necessary for carbon butt groove cleaning.

Additional features and advantages of the invention will be set forth in the detailed description which follows, and in part will be readily apparent to those skilled in the art from the description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide further understanding of the invention, illustrate various embodiments of the invention, and together with the description, serve to explain the principles and operation of the invention.

DETAILED DESCRIPTION OF THE PREFERRED EMBODIMENTS

Figure 1:
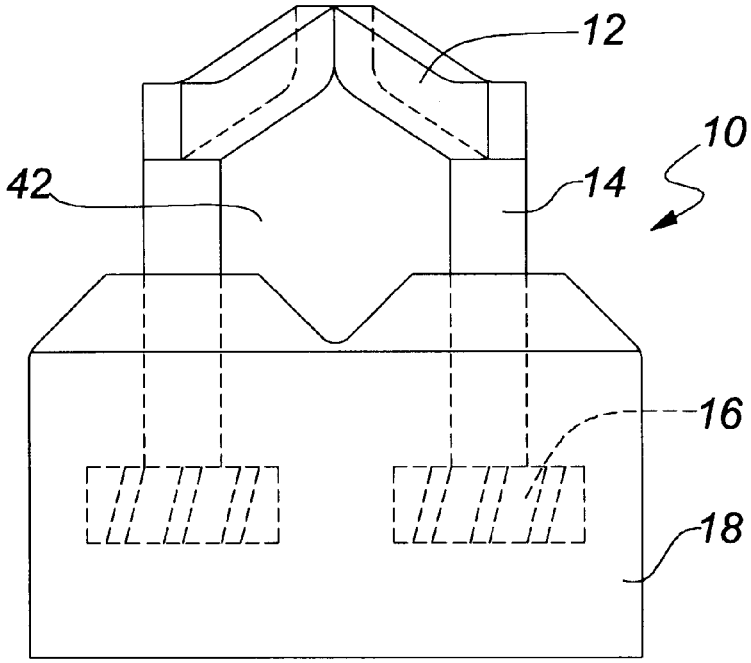
FIG. 1 is an end elevational view of a typical frame mounted carbon block used in the manufacture of aluminum.
Figure 2:
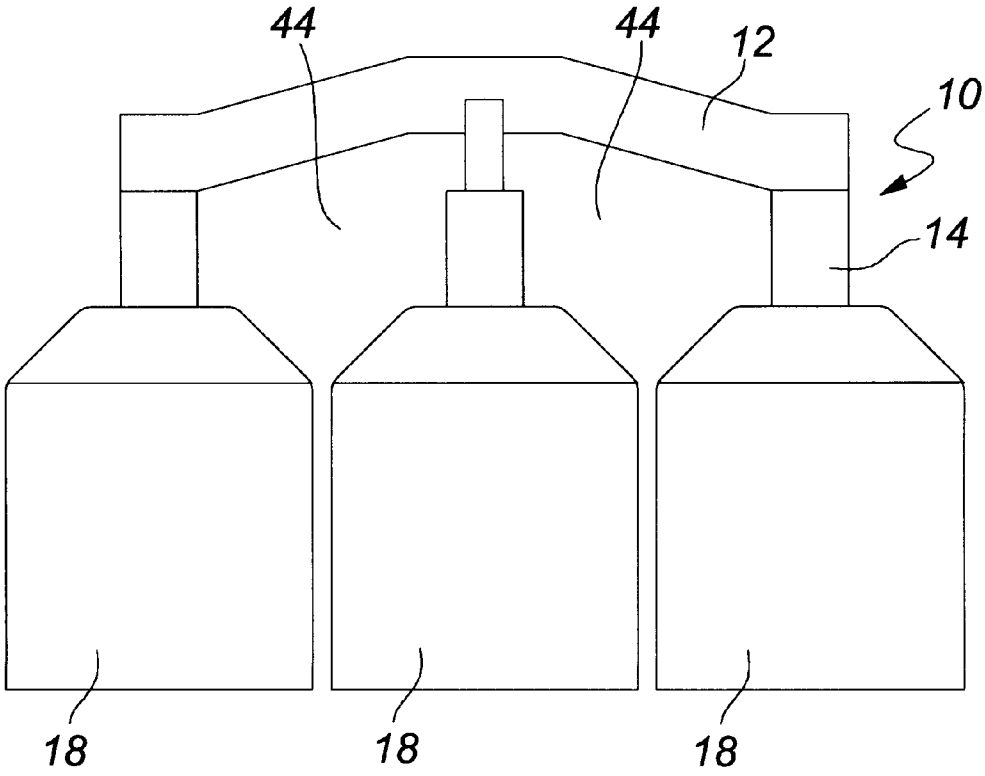
FIG. 2 is a side elevational view of the frame mounted carbon block of FIG. 1.

FIGS. 1 and 2 generally depict typical frame mounted carbon blocks 10, which form the anodes within aluminum reduction cells employed in aluminum smelting facilities. Frame mounted carbon block 10 generally includes a steel yolk 12 having a plurality of stubs 14 depending therefrom. Generally speaking, an iron mounting block 18 is affixed to each steel stub 14, and is threaded or otherwise textured to support a carbon block 18 thereon. Although not shown in the drawing figures, an electrically conductive bar or riser (not shown) typically extends vertically from yolk 12 to support frame mounted carbon block 10 within the bath (not shown). The riser (not shown) is generally constructed of a lower resistive material than steel, such as aluminum, to reduce electrical losses over its length. Once suspended within the bath mixture (not shown) aluminum reduction ensues with a majority of the bath mixture (not shown) being maintained in a molten state. Over time, however, an upper layer of the bath material is cooled by exposure to the atmosphere surrounding the non-emersed portion of frame mounted carbon block 10 to form a crusted upper layer. This solid bath layer acts as an insulator to efficiently retain heat within the pot (not shown). When carbon blocks 18 are sufficiently spent, the crusted upper layer is physically broken and frame mounted carbon blocks 10 are extracted from the molten mixture (not shown) for replacement.

Figure 3:
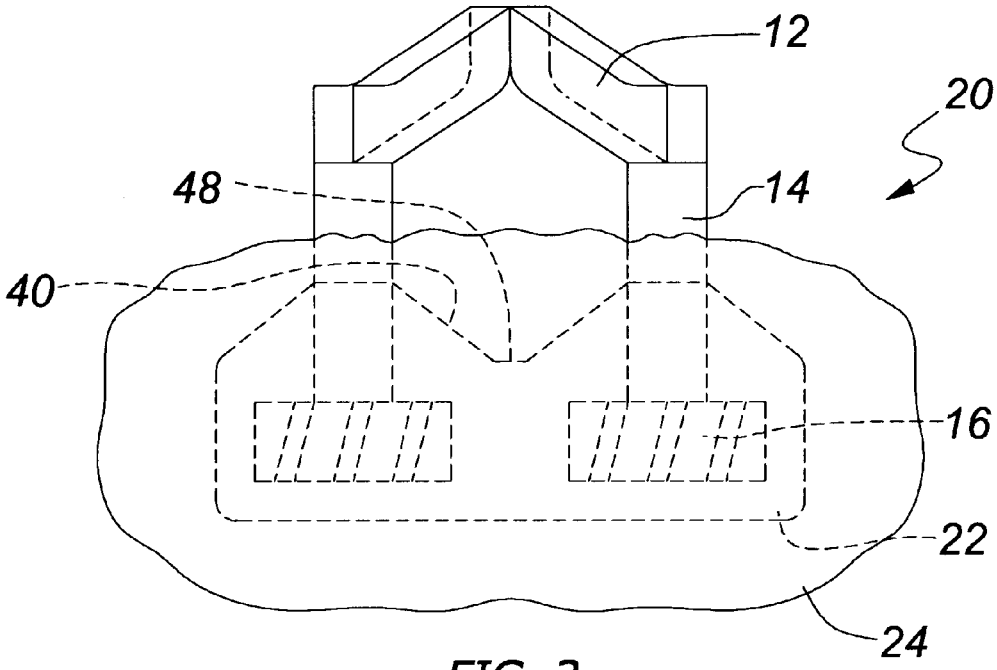
FIG. 3 is an end elevational view of a spent carbon anode encrusted in cryolite.
Figure 4:
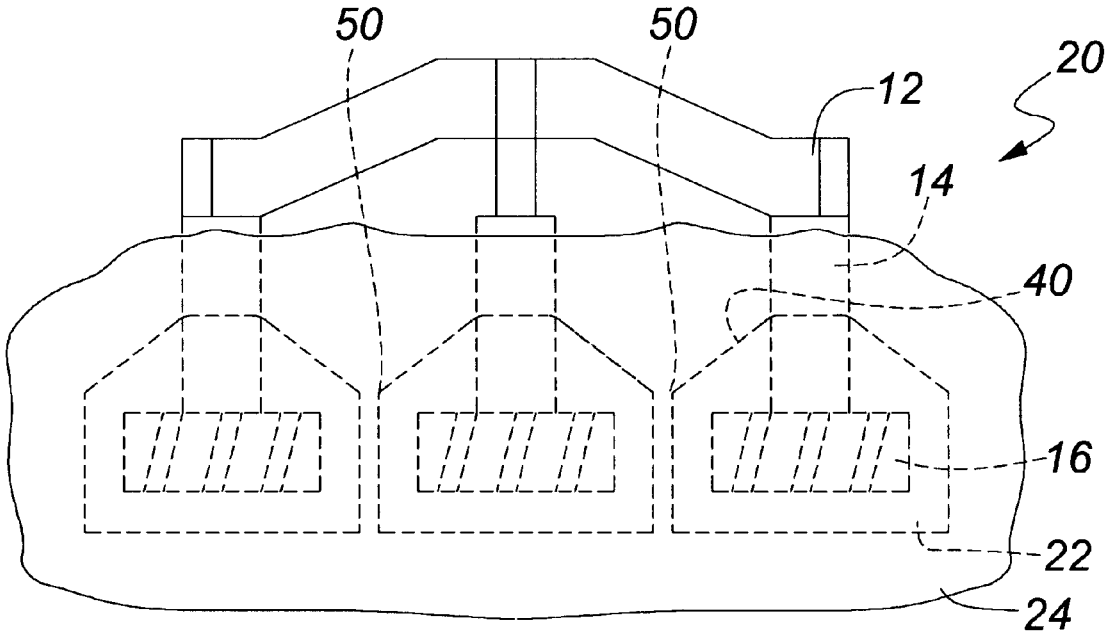
FIG. 4 is a side elevational view of the spent carbon anode of FIG. 3 shown encrusted in cryolite.

When removed, spent carbon anodes 20 such as those depicted in FIGS. 3 and 4 are substantially covered with a hardened encrustation 24 formed predominantly of cryolite. During the smelting process, the once substantial carbon blocks 18 are reduced to carbon remanents or butts 22 which are substantially encased within encrustation 24. Encrustation 24 typically extends upward around at least a portion of stub 14, and prevents access to the desired carbon butts 22.

Reference will now be made in detail to the present preferred embodiments of the invention, examples of which are illustrated in the accompanying drawings. Wherever possible, the same reference numerals will be used throughout the drawing figures to refer to the same or like parts. Although the individual apparatus' and method steps of the present invention are themselves independently inventive, the preferred embodiment of the invention will be described herein with reference to one or more preferred systems for cleaning or stripping encrustation 24 from spent carbon anodes 22. Additional details relating to one or more conveying mechanisms, cleaning station housings, and associated devices capable of being employed with the inventive system of the present invention can be found in U.S. Pat. No. 4,557,009, entitled, Carbon Electrode Cleaning System, issued on Dec. 10, 1985 to Raymond J. Dill, which is hereby incorporated by reference herein, in its entirety.

Figure 5:
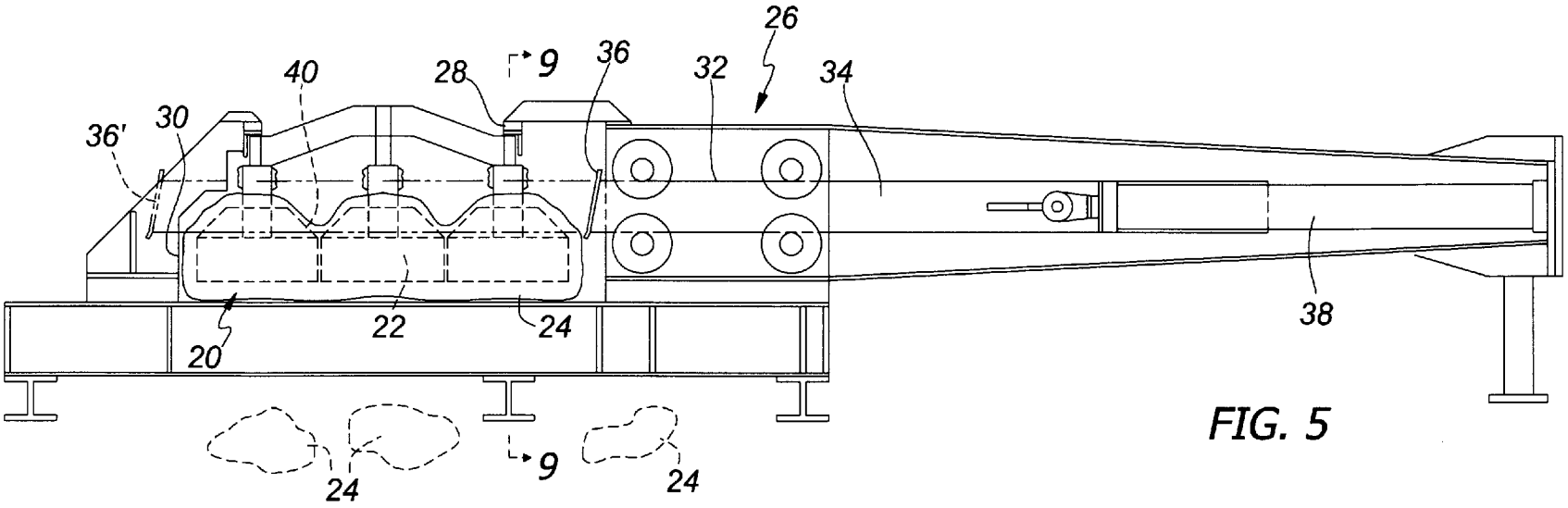
FIG. 5 is a side elevational view of a preferred embodiment of the plow assembly illustrating a spent carbon anode cleaning step in accordance with the present invention.
Figure 6:
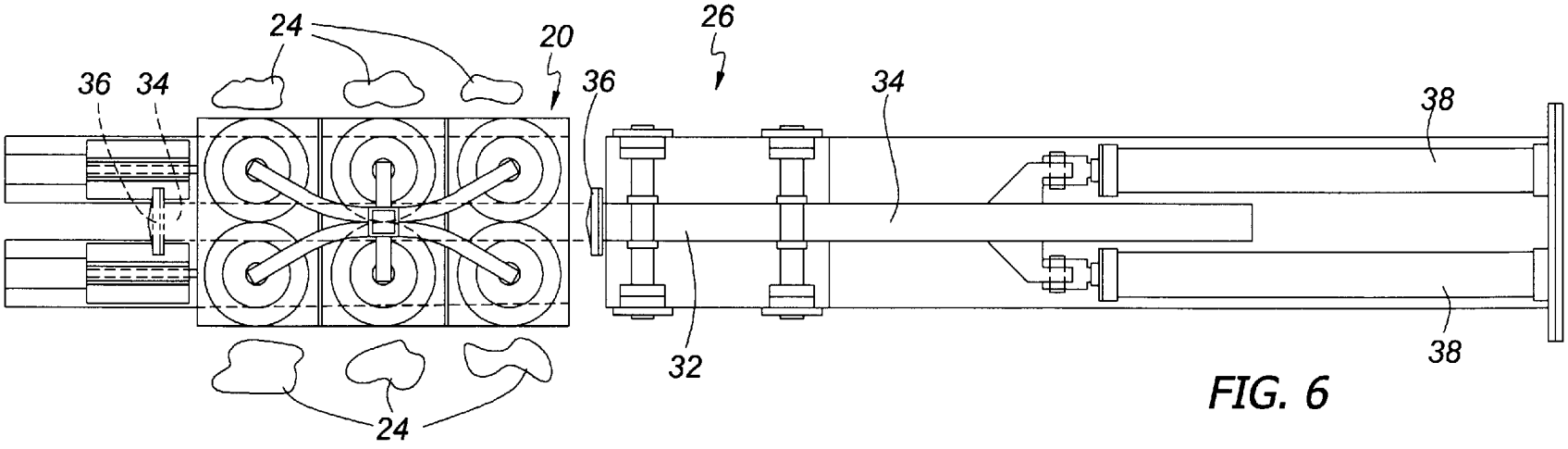
FIG. 6 is a top plan view of the plow assembly of FIG. 5 depicting a spent carbon anode cleaning step in accordance with the present invention.

An exemplary embodiment of the plow assembly of the present invention is shown in FIGS. 5 and 6 and is designated generally throughout by reference numeral 26. Generally speaking, following removal from the bath (not shown) a spent carbon anode 20 preferably is transported to plow assembly 26 via a conventional conveying system (not shown). Spent carbon anode 20 is preferably passed through an entrance door along guide bars (not shown) onto plow assembly 26 where it is engaged by stopping locks 28 and backstop 30. When engaged, the entrance doors, controlled by a control device such as a computer, automatically close so that spent carbon anode 20 can be acted upon within the first station of the system of the present invention.

Plow assembly 26 preferably includes an axially extending plow which includes an extendable plow beam 34 and an end mounted plow blade 36. When spent carbon anode 20 is properly positioned on plow assembly 26, thrust cylinders 38 driven hydraulically by motors and pumps (not shown) are engaged to extend plow beam 34 in the direction of spent carbon anode 20. As plow blade 36 engages encrustation 24 surrounding spent carbon anode 20, plow blade 36 is urged through encrustation 24 to its fully extended position 36'. As a result, large masses of encrustation 24 are dislodged from spent carbon anode 20 and simply fall onto a conveying system or catch basin (not shown) positioned beneath plow assembly 26.

Figure 7:
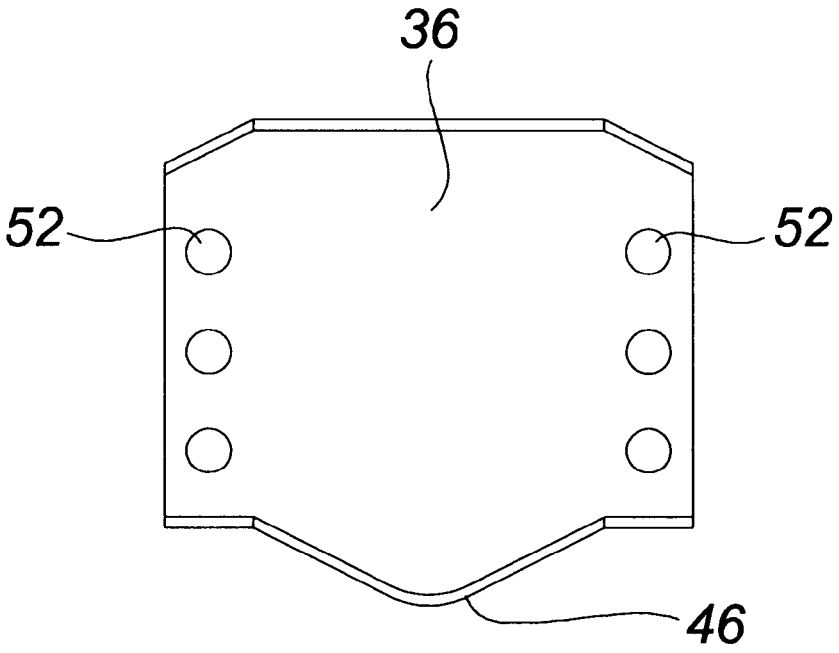
FIG. 7 is a front elevational view of a preferred embodiment of the plow blade of the present invention.
Figure 8:
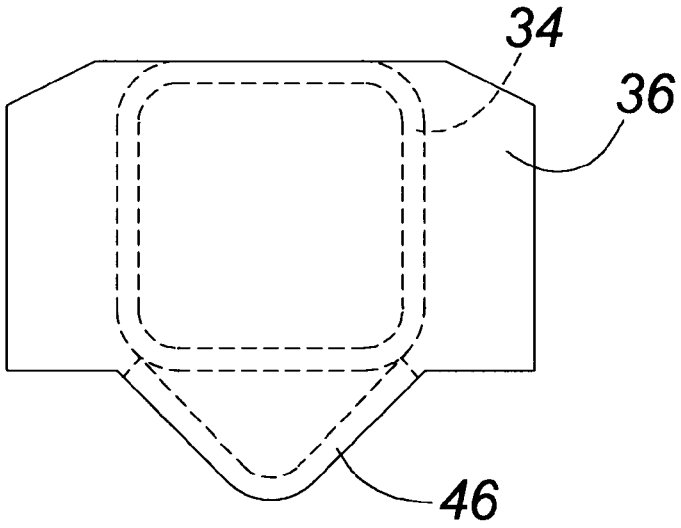
FIG. 8 is a front elevational view of the plow blade of FIG. 7 shown mounted on a plow beam.

In order to effectively and efficiently dislodge the massive portions of encrustation 24 from spent carbon anode 20, plow blade 36 is preferably sized and shaped to substantially conform to the upper surface 40 of the carbon butt 22, as shown in FIGS. 7 and 8. As suggested above with reference to the operation of plow assembly 26, plow blade 36 is preferably shaped so as to freely pass through a lengthwise void 42 (FIG. 1) or a cross void 44 (FIG. 2) defined between the upper surface of carbon blocks 18 and yolk 12. Preferably, plow blade 36 includes a downwardly depending generally V-shaped channel extension 46 that is sized and shaped to substantially mate with the lengthwise groove 48 extending longitudinally along upper surface 40 of carbon butt 22 (FIG. 3) and/or the lateral groove 50 extending laterally across upper surface 40 of carbon butt 22 (FIG. 4). Referring again to FIG. 7, plow blade 36 and channel extension 46 are preferably constructed of hardened steel or some other sufficiently hard metal so as to withstand repeated use. In addition, plow blade 36 preferably includes a plurality of apertures 52 for receiving lag bolts or other fasteners so that plow blade 36 can be securely mounted to extendable plow beam 34 as shown in FIG. 8.

Figure 9:
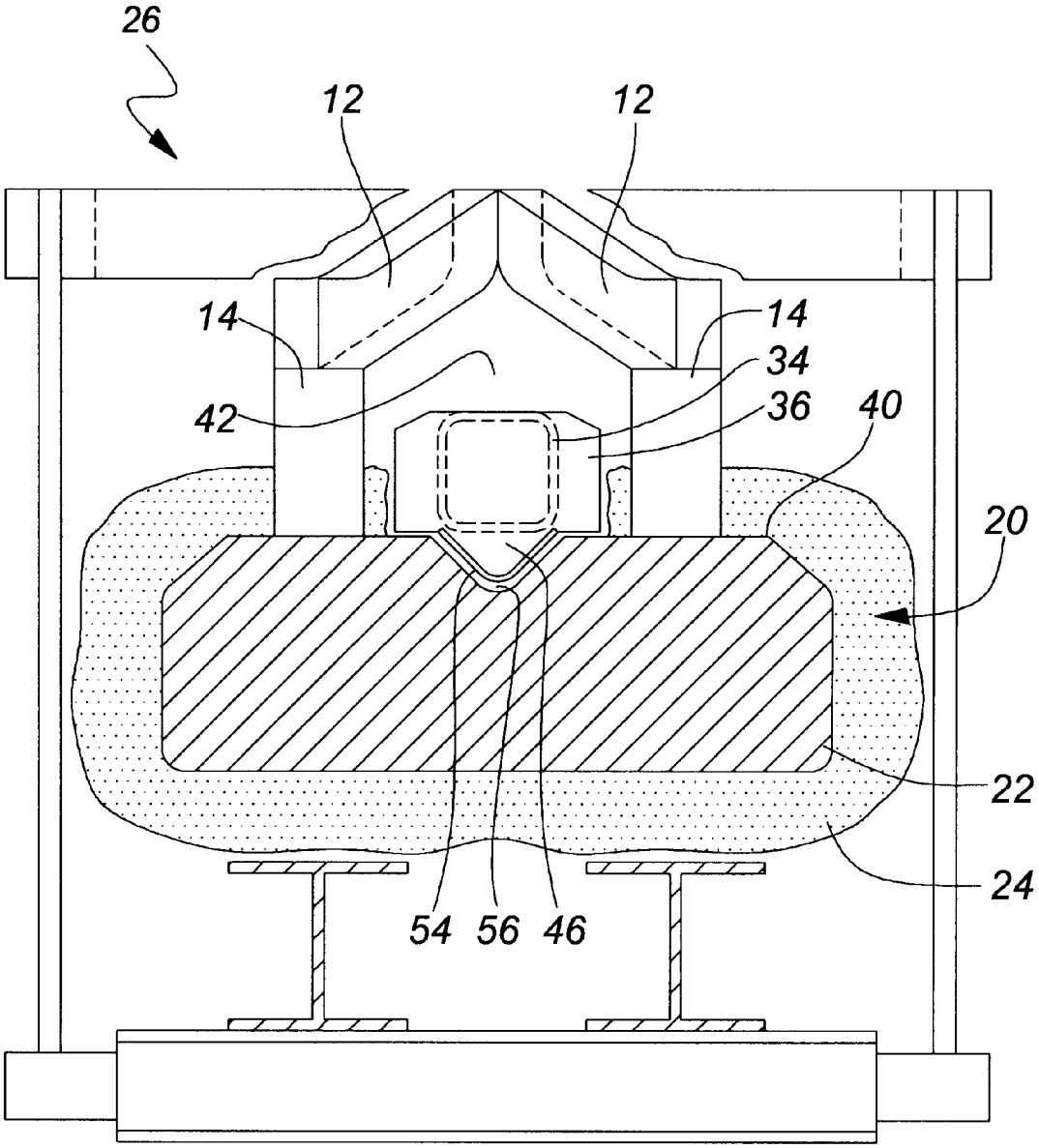
FIG. 9 is a cross-sectional view of the plow assembly of FIG. 5 taken generally along line 9—9 in FIG. 5.
Figure 11:
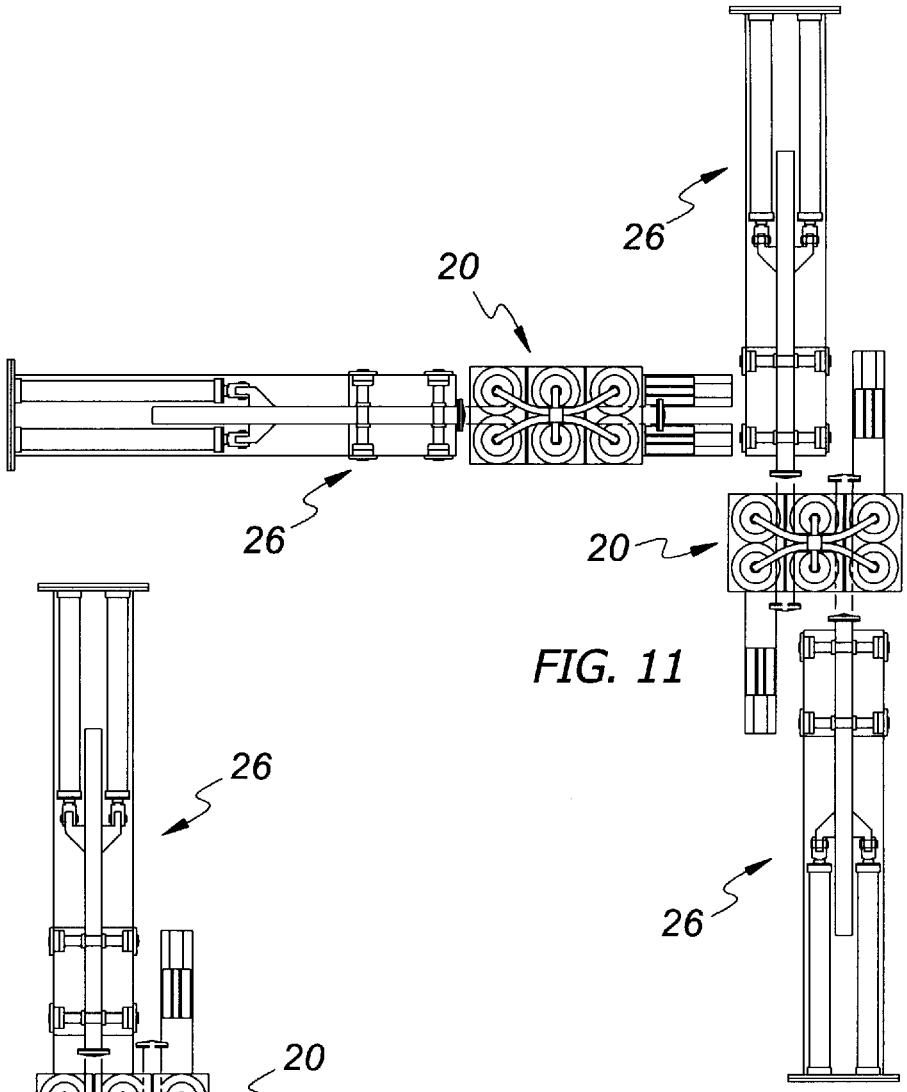
FIG. 11 is a top plan view of a plurality of plow assemblies shown configured for both in-line plow and cross-plow operation.
Figure 10:
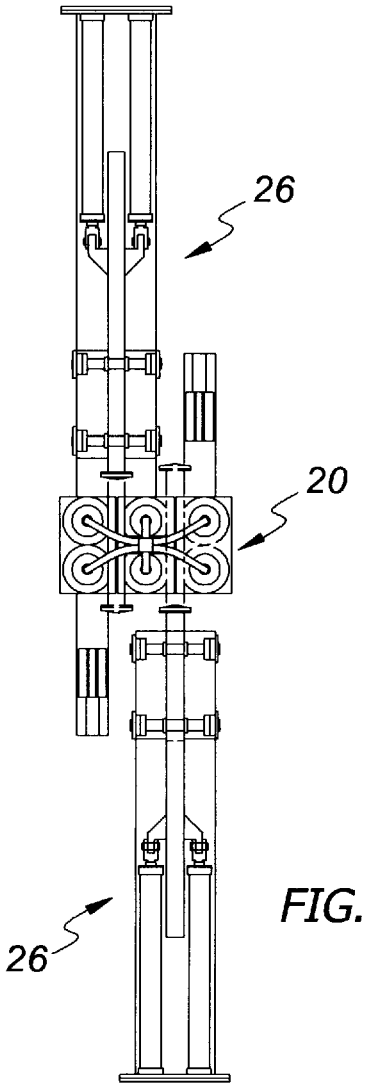
FIG. 10 is a top plan view of a plurality of plow assemblies shown configured for cross-plow operation.

Referring now to the cross-sectional view of FIG. 9, when spent carbon anode 20 is properly seated within plow assembly 26, plow blade 36 passes through lengthwise void 42 such that the bottom edge 54 of plow blade 36 engages the crust line 56 of encrustation 24 formed on carbon butt 22. As plow blade 36 is urged longitudinally, through spent carbon anode 20 sufficient force is applied at crust line 56 to separate and dislodge the massive portions of encrustation 24 from spent carbon anode 20. In addition, channel extension 46 ensures that a significant portion of encrustation 24 seated within lengthwise groove 48 is dislodged as well. During operation, backstop 50 (FIG. 5) preferably provides the necessary counteracting force to yolk 12 and stubs 14 to facilitate complete passage of plow blade 36 through spent carbon anode 20. Once extendable plow beam 34 has been fully extended, it is thereafter retracted within plow assembly 26 and spent carbon anode 20 is prepared for the second station of the system of the present invention. If desired, and if time permits, additional plow assemblies 26 can be incorporated into the plowing station of the system of the present invention. One such embodiment could include a pair of staggered plow assemblies 26 arranged on opposite sides of spent carbon anode 20 to permit simultaneous cross void 44 cleaning of spent carbon anode 20 as shown in FIG. 10. Moreover, as shown in FIG. 11, an alternative embodiment could incorporate three plow assemblies 26 to combine both lengthwise void 42 cleaning and cross void 44 cleaning as shown in FIG. 11.

Figure 12:
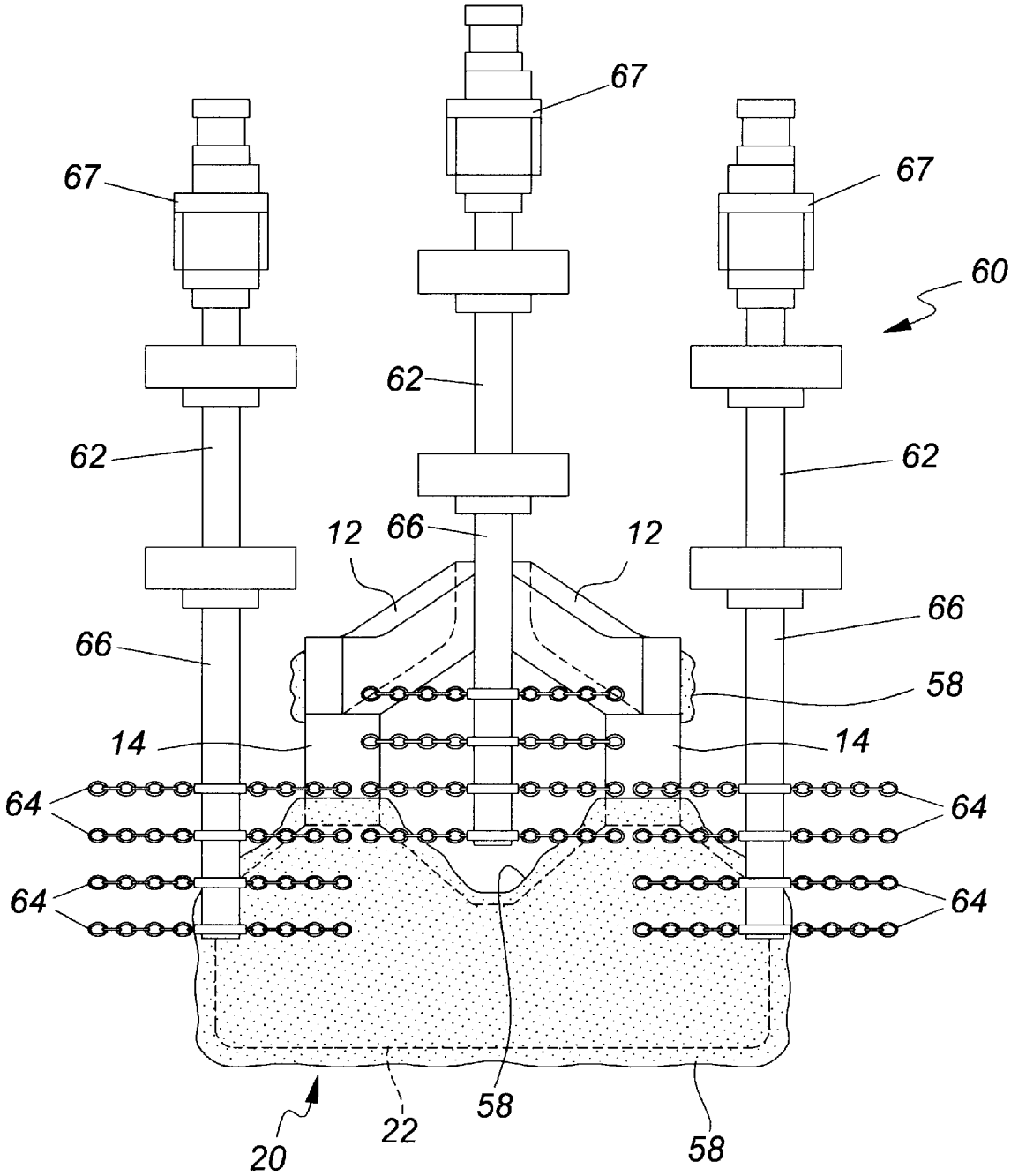
FIG. 12 is an end view of a spent carbon anode shown approaching a preferred vertically mounted horizontal flailing assembly station in accordance with the present invention.

Following plowing, spent carbon anode 20 carrying residual cryolite encrustation 58 is preferably conventionally conveyed to a second cleaning station 60, which preferably includes one or more vertically mounted horizontal cleaning assemblies (hereinafter "horizontal flailing assemblies") 62 as depicted in FIG. 12. Horizontal flailing assemblies 62 preferably include a plurality of flailing elements, such as steel chains, which are rotatably coupled to elongated generally vertical shafts 66. Each shaft is preferably separately driven by a dual directional hydraulic motor 67 which in turn causes flailing elements 64 to rapidly rotate about shafts 66 upon activation. It will be understood that other motors such as variable speed motors can be employed as well.

Figure 13:
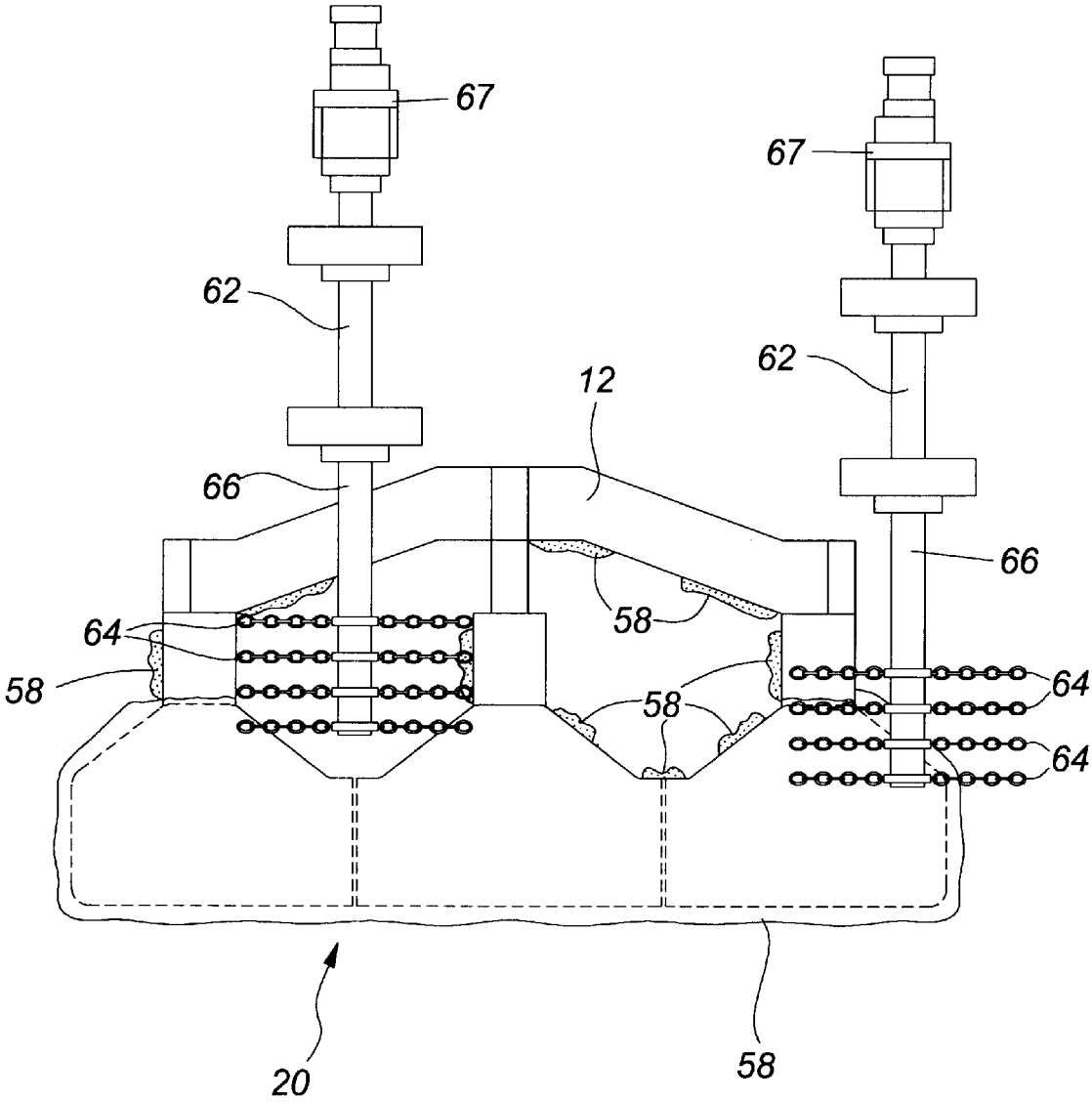
FIG. 13 is a side elevational view of a spent carbon anode shown passing through the vertically mounted horizontal flailing assembly station of FIG. 12 in accordance with the present invention.

In operation, spent carbon anode 20 is passed longitudinally between a pair of horizontal flailing assemblies 62 as flailing elements 64 are rapidly rotated to occupy a plurality of horizonal abrading planes. Horizontal flailing assemblies 62 are preferably spaced such that spent carbon anode 20 freely passes between shafts 66 while flailing elements 64 make overlapping contact between stubs 14 and a portion of yolk 12. In addition, additional flailing elements 64 contact the sides and portions of the top surface 40 of carbon butt 22 to affect "scrubbing," and thus cleaning of the contacted carbon butt surface and frame. In this way, the residual encrustation 58 contacted by flailing elements 64 is rapidly and controllably abraded away from spent carbon anode 20. Optionally, a third centrally mounted horizontal flailing assembly 62 can be reciprocally mounted above spent carbon anode 20 within second station 60. If employed, centrally mounted horizontal flailing assembly 62 can be selectively lowered into engagement with the forward and rearward ends of spent carbon anode 20 as spent carbon anode 20 is passed through second station 60. When employed, it will be understood by those skilled in the art that retraction of the centrally mounted horizontal flailing assembly 62 will be controlled via computer or other control mechanism so that shaft 62 clears yolk 12 of spent carbon anode 20 as spent carbon anode 20 passes through second station 60. In this way, additional cleaning of the forward and rearward surfaces of spent carbon anode 20 can be affected. Moreover, and as depicted in FIG. 13, it will also be understood by those skilled in the art that horizontal flailing assembly 62 can be offset longitudinally with respect to spent carbon anode 20. Although overlapping of the flailing element 64 will not be affected in such an embodiment, sufficient contact is made between flailing element 64 and spent carbon anode 20 to abrade away much of the residual encrustation 58 carried by spent carbon anode 20.

Figure 14:
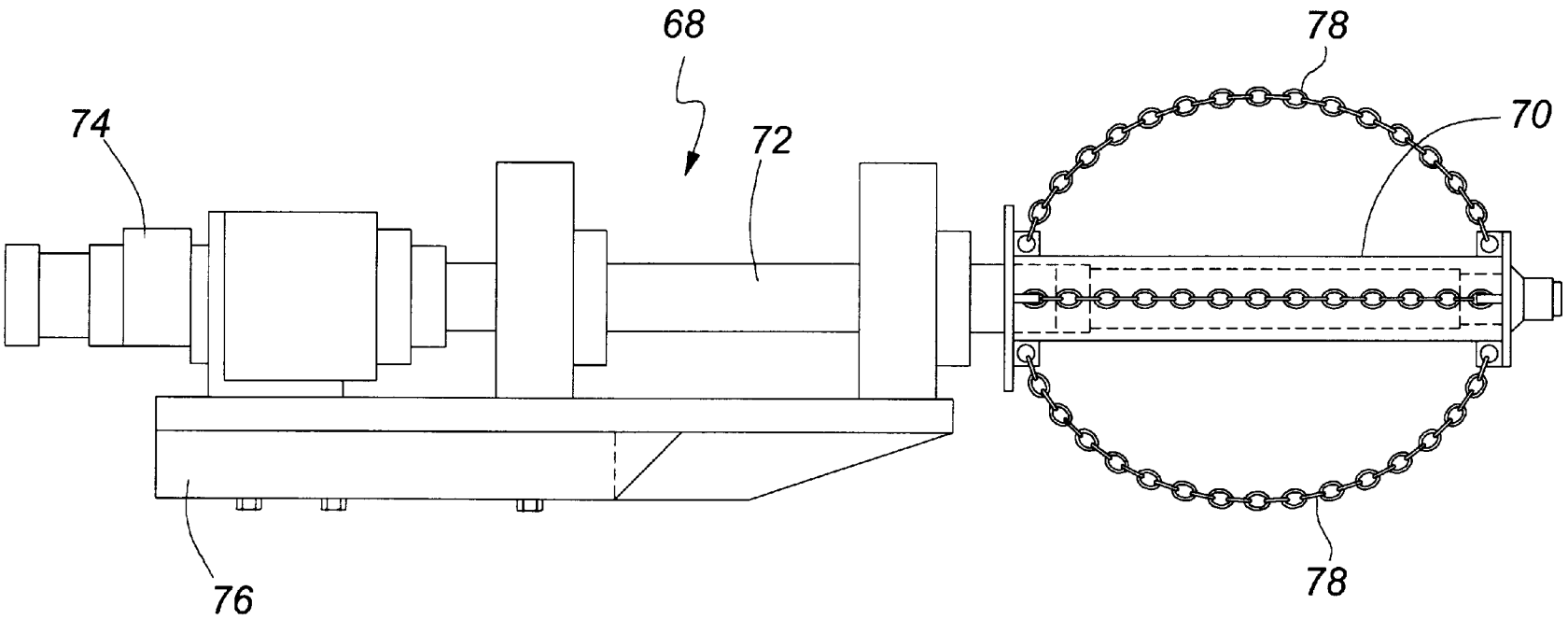
FIG. 14 is a side elevational view of a preferred horizontally mounted vertical flailing assembly in accordance with the present invention.

Due, at least in part, to the increased hardness of encrustation 24 resulting from improved smelting techniques, and to the shape of upper surface 40 of carbon butt 22, a significant amount of residual encrustation 58 remains affixed to spent carbon anode 20 following horizontal flailing within second station 60. As a result, a need has arisen for a device that is capable of scrubbing the unabraded portions of spent carbon anode 20. A first preferred embodiment of such a device is depicted in FIG. 14 and referred to generally throughout as curvilinear orbital flailing assembly 68. Curvilinear orbital flailing assembly 68 preferably includes a flail head 70 rotatably coupled to an extendable thrust cylinder 72 both of which are driven by one or more hydraulic motors 74. Curvilinear orbital flailing assembly 68 further includes a support platform for mounting curvilinear orbital flailing assembly 68 to the support member (not shown) of a third cleaning station housing (not shown).

Figure 15:
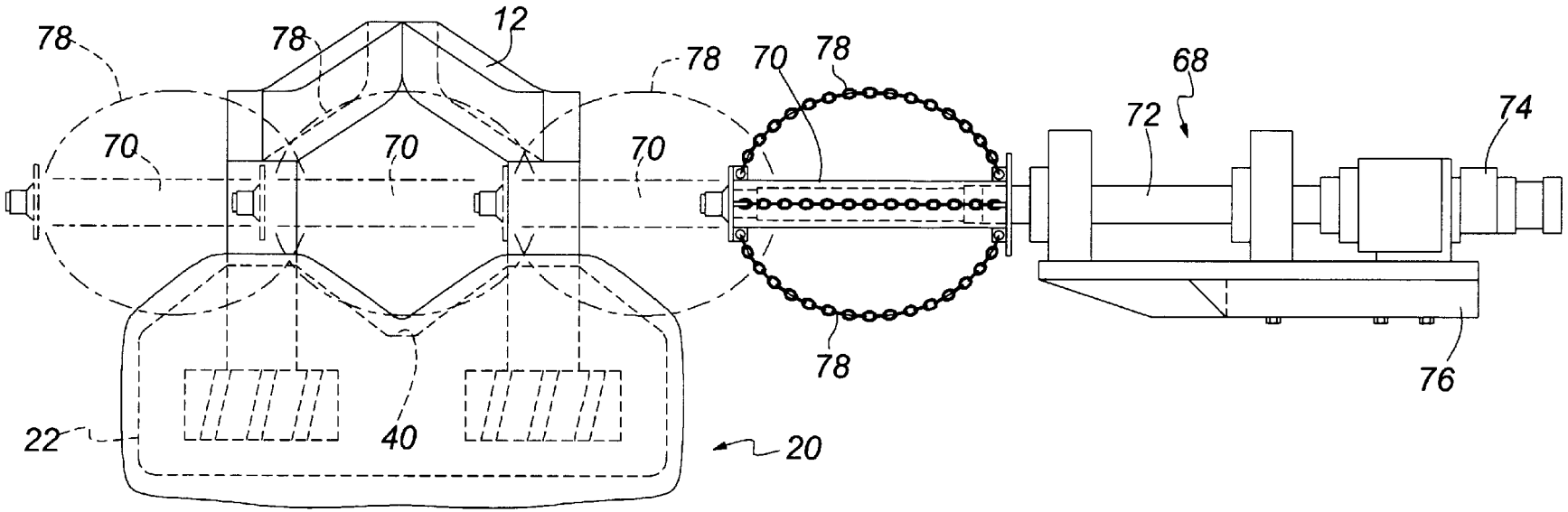
FIG. 15 is a side elevational view depicting the operation of the horizontally mounted vertical flailing assembly of FIG. 14.

Flail head 70 preferably includes a plurality of spaced end mounted flailing elements 78 that are loosely affixed to flail head 70. Thus, upon rotation of flail head 70, end mounted flailing elements 78 assume a generally curvilinear orbital path about flail head 70. As shown in FIG. 15, and when rotated, end mounted flailing elements 78 essentially conform to the concave shape of the lateral grooves 50 extending along upper surface 40 of carbon butt 22. As a result, the unabraded residual encrustation 58 residing within lateral grooves 50 on upper surface 40 of carbon butt 22 are scrubbed and abraded away by the rapid rotation of end mounted flailing elements 78. In addition, contact is also made between end mounted flailing elements 78 and the bottom surfaces of yolk 12 of spent carbon anode 20. Accordingly, any unabraded residual encrustation 58 residing thereon is also removed.

Figure 16:
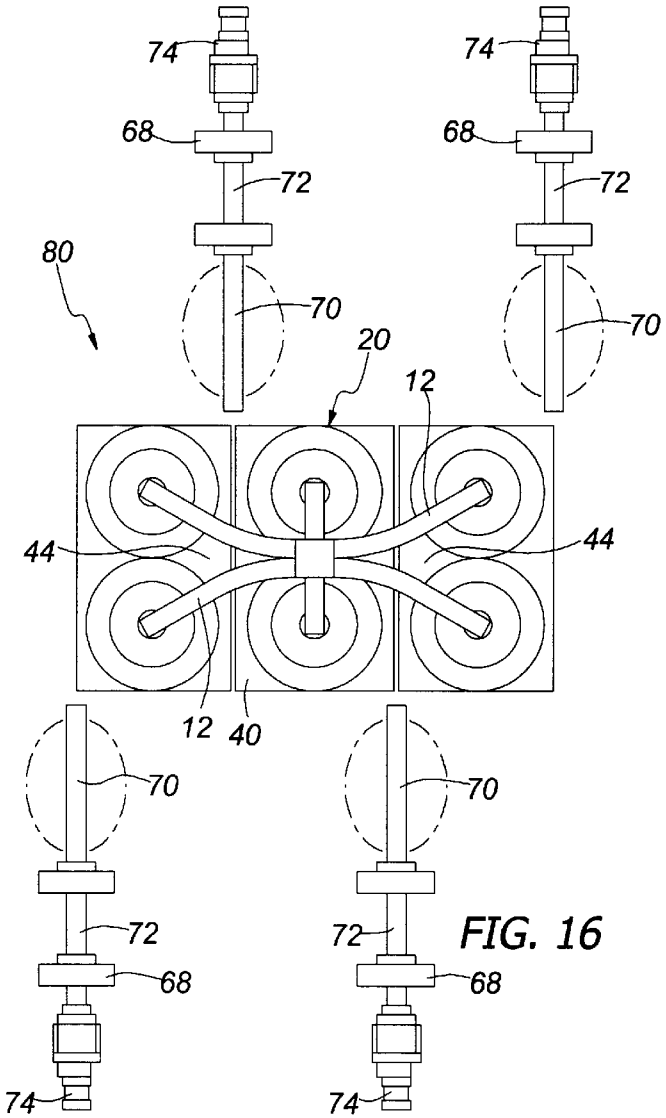
FIGS. 16 and 17 depict the operation of a preferred horizontally mounted vertical flailing assembly station in accordance with the present invention.
Figure 17:
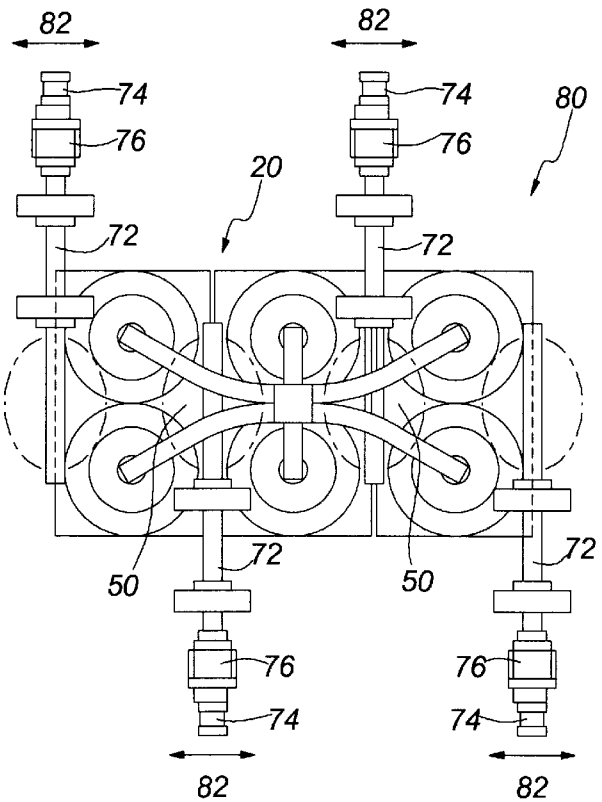

A preferred embodiment of a third cleaning station 80 incorporating a plurality of orbital flailing assemblies 68 is shown in operation in FIGS. 16 and 17. Following horizontal flailing, spent carbon anode 20 is preferably conventionally conveyed end first into third cleaning station 80 until spent carbon anode 20 is engaged by stopping locks (not shown). Once engaged, spent carbon anode 20 is preferably aligned with a pair of longitudinally offset horizontally mounted vertical flailing assemblies 68 spaced on opposite sides of spent carbon anode 20. Although the horizontally mounted vertical flailing assemblies 68 could incorporate flailing elements similar to flailing elements 64 as described above with respect to second station 60, horizontally mounted vertical flailing assemblies are preferably curvilinear orbital flailing assemblies 68 substantially similar to those described above with reference to FIGS. 14 and 15. More specifically, curvilinear orbital flailing assemblies 68 are preferably positioned with respect to spent carbon anode 20 such that the opposed outer pair of flail heads 70 are aligned to engage the ends of spent carbon anode 20 upon extension of thrust cylinder 72, while the inner opposed pair of flail heads 70 are positioned with respect to spent carbon anode 20 such that, upon extension of thrust cylinder 72, flail heads 70 extend into cross voids 44 located between upper surface 40 of spent carbon anode 20 and yolk 12.

As shown in FIG. 17, once a controller (not shown) receives a signal that the stopping locks (not shown) are engaged, motors 74 engage to rotate flail head 70. Support platforms 76, preferably powered carrier platforms movable in both the lengthwise and crosswise direction (longitudinally and laterally, respectively), are also engaged to extend thrust cylinders 72 to move rotating flail heads 70 into engagement with spent carbon anode 20. Once fully extended, the curvilinear orbitally rotating flail heads 70 are positioned at the longitudinal center line of spent carbon anode 20 where residual encrustation 58 remaining on the ends of carbon butt 22 and within lateral grooves 50 will be abraded away. After a predetermined period of time, carrier platforms 76 will be moved laterally with respect to spent carbon anode 20, first to one side, and then the other, as indicated by directional arrows 82 (FIG. 17). In this way, surviving residual encrustation 58 affixed to the stubs 14 and yolk 12 is abraded away. When this stage of the cleaning operation is complete, carrier platforms 76 will preferably move orbital flailing assembly 68 to the center or starting position, motors 74 will disengage, and carrier platform 76 will retract thrust cylinders 72 so that spent carbon anode 20 can be moved for further processing.

Figure 18:
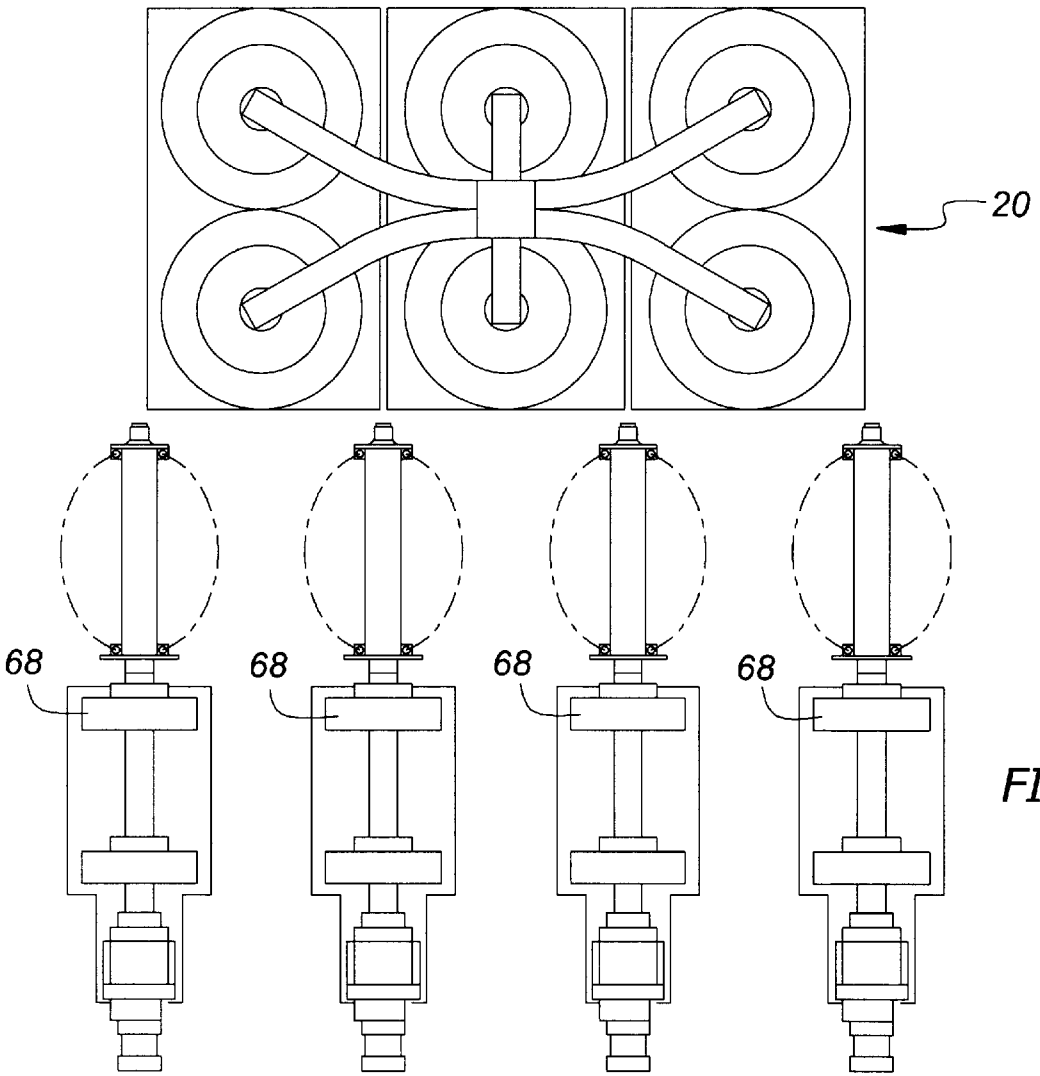
FIG. 18 is a top plan view of an alternate vertical flailing assembly station in accordance with the present invention; and, FIG. 19 is an end elevational view of a spent carbon anode shown positioned within a preferred bottom cleaning station in accordance with the present invention.

While the third cleaning station 80 has been described above with reference to a preferred arrangement of curvilinear orbital flailing assemblies 68, it will be understood by those skilled in the art that other flailing assembly arrangements are encompassed within the scope of the present invention. For example, horizontally mounted vertical flailing assemblies such as curvilinear orbital flailing assembly 68 can be extended into engagement with spent carbon anode 20 from one or both ends of spent carbon anode 20. Moreover, horizontally mounted vertical flailing assemblies such as curvilinear orbital flailing assemblies 68 can be arranged as a single co-planer bank of flailing assemblies as depicted in FIG. 18.

Figure 19:
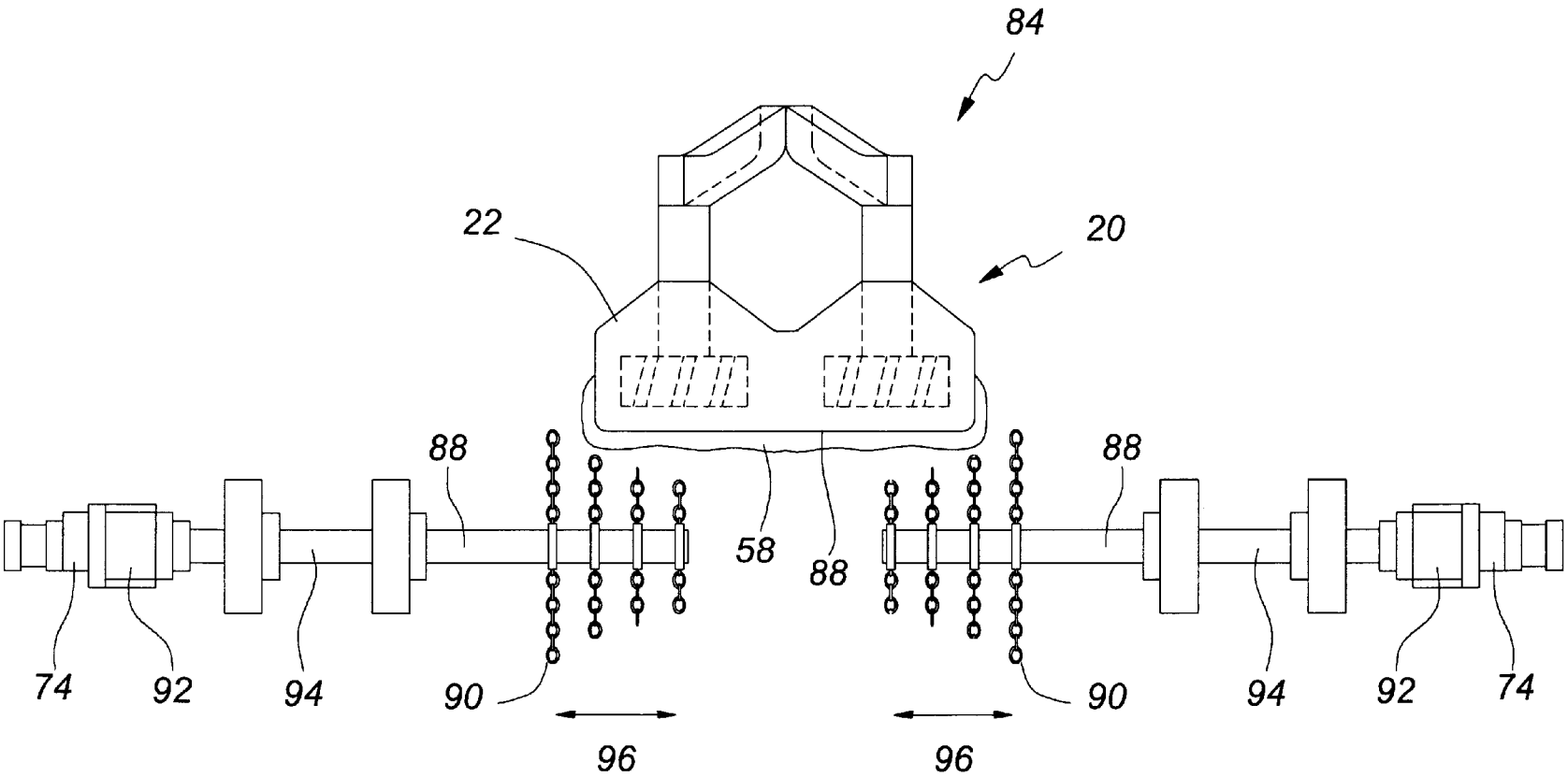

A second alternative embodiment of a device for scrubbing the unabraded portions of spent carbon anode 20 following cleaning operations at second station 60 is illustrated in FIG. 19. In a preferred embodiment of the system of the present invention, the device depicted in FIG. 19 forms a forth cleaning station 84 for spent carbon anodes 20. However, it will be understood by those skilled in the art that in some instances sufficient cleaning of spent carbon anode 20 can be affected with less than all of the three flailing stations described herein.

As depicted in FIG. 19, fourth cleaning station 84 preferably includes a plurality of opposed horizontally mounted vertical flailing assemblies 86 arranged to engage the bottom 88 of spent carbon anode 20. Following departure from a previous cleaning station, spent carbon anode 20 is conventionally conveyed into fourth cleaning station 84 until engaged by stopping locks (not shown). Once engaged, motors 74 rotate vertical flailing elements 90 and carrier platforms 92 extends thrust cylinders 94 in the direction of spent carbon anode 20 as indicated by directional arrows 96. Preferably, horizontal flailing assemblies 86 are offset longitudinally with respect to spent carbon anode 20 so that flailing elements 90 affect overlapping coverage of bottom 88 of spent carbon anode 20 as carrier platform 92 traverses flailing assemblies 86 longitudinally along the length of spent carbon anode 20. In this way, residual encrustation 58 affixed to bottom 88 of spent carbon anode 20 is abraded away by the rapid rotation of flailing elements 90. Moreover, flailing elements 90 preferably vary in length with the longest elements residing nearest motors 74. So arranged, flailing elements 90 substantially conform to the rounded shape of the sides of carbon butt 22 thereby maximizing abrasion coverage for the greatest amount of carbon butt 22 surface area at any given time. In addition, the longer flailing elements 90 reach previously unremoved encrustation 58 extending up the side walls of carbon butt 22. Upon completion of cleaning within fourth cleaning station 84, spent carbon anode 20, preferably void of any residual encrustation 58, is conventionally conveyed for further processing and/or recycling.

It will be apparent to those skilled in the art that various modifications and variations can be made to the present invention without departing from the spirit and scope of the invention. For example, the above-described flailing stations can be encountered by spent carbon anodes 20 in a different order than that order described above. Thus, it is intended that the present invention cover the modifications and variations of this invention provided they come within the scope of the appended claims and their equivalents.

What is claimed is:

1. A method of cleaning a spent carbon anode, said spent carbon anode comprising a carbon butt, a frame including a yoke and stubs for supporting said carbon butt, and an encrustation affixed to said spent carbon anode, said method comprising the steps of:

a) urging a plow blade into and through the encrustation such that said plow blade passes between the frame and the carbon butt to disengage a significant portion of the encrustation from the spent carbon anode;

b) rotationally engaging the frame and carbon butt with first flailing elements rotating in a first plane with respect to the spent carbon anode to abrade additional encrustation from the spent carbon anode; and c) rotationally engaging the frame and carbon butt with second flailing elements rotating in a second plane with respect to the spent carbon anode to further abrade additional encrustation from the spent carbon anode, said second plane being substantially orthogonal to said first plane.

2. The method of claim 1 further comprising the step of rotationally engaging the bottom of the carbon butt with third flailing elements rotating in a third plane spaced from and substantially parallel to said second plane to abrade additional encrustation affixed to the bottom of the spent carbon anode.

3. The method of claim 1 wherein each of said second flailing elements includes a first and second end, and wherein the first and second ends are each attached to said second flailing assembly such that said flailing elements travel in a curvilinear orbital path upon rotation of said flailing assembly.

* * * * *